US006923105B1

(12) United States Patent
Gieseke et al.

(10) Patent No.: US 6,923,105 B1
(45) Date of Patent: Aug. 2, 2005

(54) GUN-ARMED COUNTERMEASURE

(75) Inventors: Thomas J. Gieseke, Newport, RI (US); Robert Kuklinski, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/679,687

(22) Filed: Oct. 6, 2003

(51) Int. Cl.[7] ..... B63G 9/00

(52) U.S. Cl. ..... 89/1.13; 42/1.14; 102/402; 114/317

(58) Field of Search ..... 42/1.14; 89/1.13, 89/5; 102/402, 403; 114/20.1, 20.2, 316–320

(56) References Cited

U.S. PATENT DOCUMENTS 1,131,761 A * 3/1915 Wheaton ..... 114/316
1,295,355 A * 2/1919 Myers ..... 114/20.1
4,993,344 A 2/1991 Jones
5,247,887 A * 9/1993 Drimmer ..... 102/399
5,267,220 A * 11/1993 Burt ..... 367/131
5,363,343 A 11/1994 Klein
5,602,801 A 2/1997 Nussbaum et al.
5,686,694 A 11/1997 Hillenbrand et al.
5,786,545 A * 7/1998 Hillenbrand ..... 114/21.2
5,911,172 A * 6/1999 Korolenko ..... 89/5
5,911,568 A * 6/1999 Kirschner et al. ..... 42/1.14
6,058,847 A * 5/2000 Adams ..... 102/402

FOREIGN PATENT DOCUMENTS

GB 2 350 172 A * 11/2000

* cited by examiner

*Primary Examiner*—Stephen M. Johnson
(74) *Attorney, Agent, or Firm*—James M. Kasischke; Michael P. Stanley; Jean-Paul A. Nasser

(57) ABSTRACT

A device for countermeasuring an underwater target is provided. The device generally comprises a module having inflatable buoyancy chambers that allow the module to hover at a desired water depth, at least one acoustic array to detect the underwater target, a propulsor system for orienting the module with respect to the underwater target, and a gun for firing one or more projectiles at the underwater target.

13 Claims, 1 Drawing Sheet

GUN-ARMED COUNTERMEASURE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a weapons system designed to defeat torpedoes and other underwater targets and more particularly to a gun-armed countermeasure device.

(2) Description of the Prior Art

Presently, torpedo countermeasure systems can be grouped into two categories—passive and hard kill. Passive countermeasure systems rely upon creating distractions to attacking torpedoes causing the torpedoes to fail to locate their target. Hard-kill systems, like the anti-torpedo torpedo, physically damage attacking torpedoes so they cannot reach their target.

Passive countermeasure systems are common on surface ships and submarines with a diameter of the systems being either three and a quarter inches or six and a quarter inches. Special launchers have been developed for these countermeasure systems and have been integrated into most naval platforms. As such, an inventive countermeasure system which can be launched from existing launchers is a more receptive concept than a countermeasure system which requires a varying sized launcher or a different launcher arrangement.

Underwater gun systems have been considered in the hard-kill countermeasure category as anti-mine and anti-torpedo devices. The system is generally composed of projectiles for use underwater, a gun, a ship-mounted turret, a targeting system, and a combat system. Undersea targets are identified and localized with the specialized targeting system. The combat system provides the control commands to direct the ship-mounted turret to point the gun towards the target. The underwater gun then shoots the projectiles which are specially designed for neutralization of undersea targets at a relatively long range (typically 200 meters).

An improvement on existing countermeasure systems would be an autonomous countermeasure device for defeating torpedoes and other underwater threats.

SUMMARY OF THE INVENTION

Accordingly, it is a general purpose and primary object of the present invention to provide an autonomous countermeasure device for defeating torpedoes and other underwater threats.

To obtain the object described, there is provided a countermeasure device and method of use, the countermeasure device generally comprising an autonomous module to which the module has means for enabling the module to hover at a desired water depth, means for detecting an underwater target, means for orienting itself in a firing position, and means for firing at least one projectile at the underwater target.

Other details of the gun-armed countermeasure device of the present invention, as well as other objects and advantages attendant thereto, are set forth in the following detailed description and the accompanying drawings, wherein like reference numerals depict like elements.

DESCRIPTION OF THE PREFERRED EMBODIMENT(S)

Figure 1:
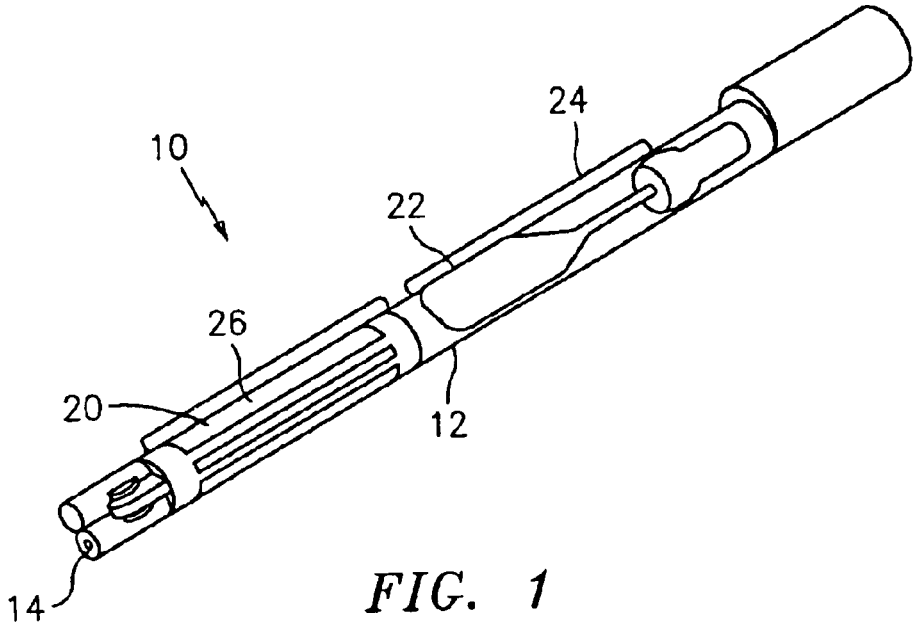
FIG. 1 is a cross-sectional view of a gun-armed countermeasure device of the present invention with the countermeasure device in a non-deployed configuration.

Referring now to FIG. 1 of the drawings, the countermeasure device 10 of the present invention is deployed as a cylindrical module 12. The module 12 of the type shown is preferably equal in diameter and length to a six and a quarter inch countermeasure device; however, the module can have other dimensions based on anticipated operating conditions. The module 12 is autonomous in that the module is not tethered to a ship or other platform which the device 10 is protecting.

Figure 2:
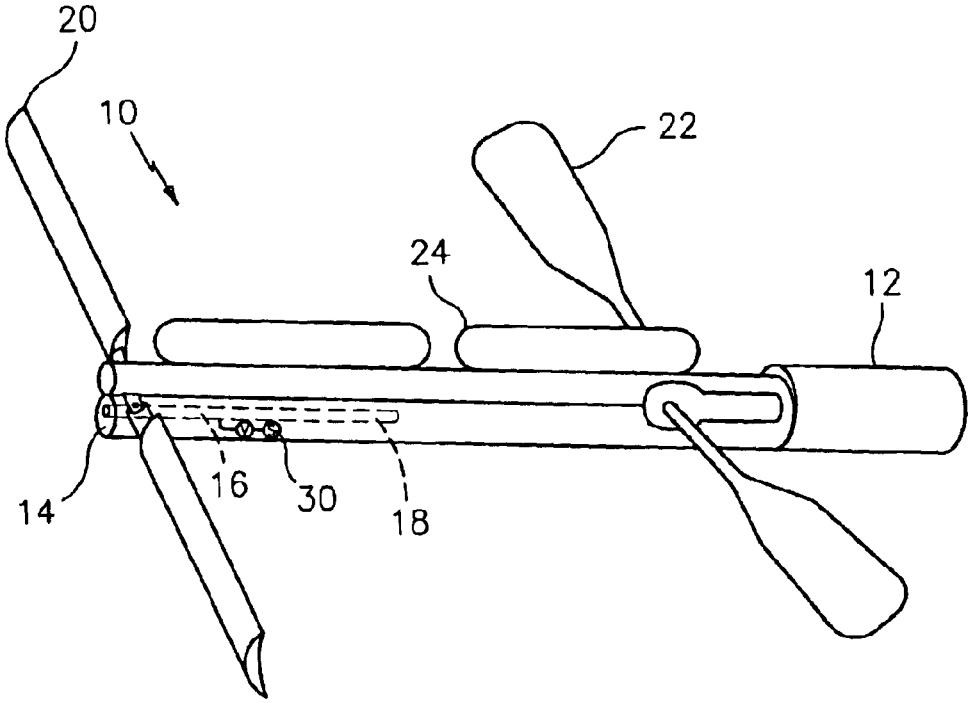
FIG. 2 is a cross-sectional view of the gun-armed countermeasure device of the present invention in a deployed configuration.

Referring to FIGS. 1 and 2, the central portion of the device 10 includes a gun 14, which has a barrel 16 and a linear magazine 18. Folded to the sides of the device 10 are acoustic array panels 20 which can be deployed to form a large aperture array that detects the underwater target. In addition to the panels 20, small propulsors such as thrusters 22 and inflatable chambers 24 are folded along the sides of the device 10. The thrusters 22 and the inflatable chambers 24 are deployed to keep the device 10 from sinking and to maneuver the device into a firing position as will be discussed further.

The acoustic array panels 20 are used to detect and localize the undersea targets, such as torpedoes (not shown). During a launch or some maneuvers of the device 10, the array panels 20 are folded against the device. Acoustic array elements 26 are positioned along the span of each acoustic array panel 20. The array elements 26 can be any suitable elements known to those skilled in the art and operate actively or passively to detect and localize the undersea target. After launch or during other maneuvers of the device 10, the array panels 20 are mechanically deployed to a predetermined angle with respect to a countermeasuring axis.

In order to minimize the range to the undersea target and to point the gun 14 at the undersea target, a plurality of propulsors, such as thrusters 22, are provided to orient the device 10. The individual thrusters 22 are located along each side of the device 10. The thrusters 22 are initially stowed within the dimensional constraints of the launcher.

After launch, the thrusters 22 are folded out to provide positioning and maneuvering of the device 10.

While any suitable thruster known in the art may be utilized, it is preferred to use flapping foils to provide the thrust. Flapping foils are preferred over standard propeller thrusters since they can provide large thrusts and are easily stowed. Any suitable means known in the art may be used to flap the foils forming the thrusters 22 and to move the thrusters between the stowed position and the folded out position.

The components, described above, within the device 10 make the device much denser than water. Consequently, added buoyancy is required to prevent the device 10 from sinking or requiring excessive thrust to maintain its depth.

Buoyancy is added to the device 10 by the inflatable chambers 24 distributed about the device to give the device a center of mass nearly coincident with the center of buoyancy. The distribution of the inflatable chambers 24 improves the maneuvering capability of the device 10 as well as allowing the device to be recovered, reloaded, and reused. The buoyancy by the inflatable chambers 24 further allows the device 10 to hover in an undersea environment at varying depths. Any suitable inflatable module known in the art may be used for the inflatable chambers 24.

The destructive mechanism of the device 10 is the gun 14. The gun 14 fires supercavitating underwater munitions capable of traveling significant underwater ranges (typically 200 meters), and capable of carrying destructive energy to their target, as either kinetic or explosive energy. Water may be initially cleared from the gun 14 with compressed air from a compressed air source 30. A burst of projectiles then follows with multiple bursts possible for firing from the device 10.

In operation, the device 10 is deployed from a countermeasure launcher (not shown) when an attack from a torpedo or some other threat is perceived. The device 10 immediately deploys its thrusters 22, inflatable chambers 24, and acoustic array panels 20 as discussed above. The device 10 then begins to scan for the threat.

When the threat is detected, the device 10 orients itself so that the gun 14 points toward the undersea target. When the undersea target is in range, compressed air from the compressed air source 30 clears the barrel 16 and then a projectile is fired. When the projectile is fired, the undersea target is reacquired and a subsequent projectile is fired. The range of the projectiles enables the device 10 to repeatedly engage an undersea target as the target approaches the vessel the device is defending. After all rounds of projectiles have been expended, the device 10 disarms itself and either ascends to the surface of the body of water for recovery or sinks to the bottom for security.

If the operational situation requires, the device 10 can operate as a mine by sitting on the bottom or hovering near the surface to target passing sea and air craft.

The countermeasure device 10 is a unique weapon system well suited for offensive strikes against marine targets, including torpedoes, mines, submarines, surface craft, etc. The device 10 has the unique features of being an autonomous and self-contained weapons system: having the ability to simultaneously maneuver and target its gun; being recoverable and reusable and having multiple alternative functions as a mine or a slow-moving weapon.

It should be noted that the gun 14 can be a "Gattling" gun, a chain gun, or a single firing system. The gun 14 can be of any size ranging from a small caliber gun (0.22") to a cannon (6").

If the operational situation requires, the thrusters 22 can act as inflatable devices, serving a dual purpose of buoyancy and maneuvering control. Further, the buoyancy can be integrated into the acoustic array panels 20.

It is apparent that there has been provided in accordance with the present invention a gun-armed countermeasure device which fully satisfies the objects, means and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A device for countering an underwater target, said device comprising:

a module;

at least one inflatable section joined to said module;

at least one propulsor extendable from said module, said propulsor capable of maneuvering said module to a firing position; and a gun partially encompassed by said module for firing at least one projectile from the firing position to counter the underwater target.

2. The device in accordance with claim 1 wherein said inflatable portion includes a plurality of inflatable chambers distributed around a perimeter of said module.

3. The device in accordance with claim 2 said device further comprising means for detecting the underwater target operably joined to said module, said propulsor and said gun.

4. The device in accordance with claim 3, wherein said device further comprises means for clearing said gun with compressed air.

5. The device in accordance with claim 2, wherein said device further comprises means for clearing said gun with compressed air.

6. A device for countering an underwater target, said device comprising:

an autonomous module;

at least one propulsor extendable from said module, said propulsor capable of maneuvering said module to a firing position;

a gun partially encompassed by said module for firing at least one projectile from the firing position to counter the underwater target; and means for acoustically detecting the underwater target, said means operably joined to said module, said propulsor and said gun.

7. The device in accordance with claim 6, wherein said device further comprises means for clearing said gun with compressed air.

8. A method for countering an underwater target comprising the steps of:

providing an autonomous hydrodynamic module having at least one propulsor and a gun;

deploying said hydrodynamic module;

acoustically detecting the underwater target;

deploying said at least one propulsor;

maneuvering said module with said at least one propulsor to a firing position; and firing said gun from the firing position thereby countering the underwater target.

9. The method in accordance with claim 8 wherein said firing step further comprises clearing said gun with compressed air.

10. The method in accordance with claim 9, wherein said firing step further comprises subsequently firing at the underwater target after clearing said gun.

11. The method in accordance with claim 10, further comprising the step of recovering said hydrodynamic module subsequent to said firing step.

12. The method in accordance with claim 10, further comprising the step of sinking said hydrodynamic module to a bottom of a body of water subsequent to said firing step.

13. The method in accordance with claim 10, said method comprising the further step of inflating chambers around the perimeter of said hydrodynamic module in order to maneuver said hydrodynamic module.

* * * * *